US010561892B2

(12) United States Patent
Johnson

(10) Patent No.: US 10,561,892 B2
(45) Date of Patent: Feb. 18, 2020

(54) POSITION ADJUSTING DEVICE FOR EXERCISING APPARATUS

(71) Applicant: Noel R. Johnson, Stoughton, WI (US)

(72) Inventor: Noel R. Johnson, Stoughton, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 4 days.

(21) Appl. No.: 15/857,644

(22) Filed: Dec. 29, 2017

(65) Prior Publication Data

US 2019/0201739 A1 Jul. 4, 2019

(51) Int. Cl.

| | |
|---|---|
| ***A63B 22/00*** | (2006.01) |
| ***A63B 22/06*** | (2006.01) |
| ***A63B 1/00*** | (2006.01) |
| *A63B 23/04* | (2006.01) |

(52) U.S. Cl.

CPC ..... *A63B 22/0046* (2013.01); *A63B 1/00* (2013.01); *A63B 22/0605* (2013.01); *A63B 23/0476* (2013.01); *A63B 2209/00* (2013.01); *A63B 2225/093* (2013.01)

(58) Field of Classification Search

CPC ..... A63B 22/0685; A63B 21/0551; A63B 21/00069

USPC ..... 248/161, 407, 408, 409, 125.8

See application file for complete search history.

(56) References Cited

U.S. PATENT DOCUMENTS

| | | | | |
|---|---|---|---|---|
| 3,690,608 | A * | 9/1972 | Poizner | F16M 3/00 248/371 |
| 6,354,557 | B1 * | 3/2002 | Walsh | B62J 1/08 248/408 |
| 7,980,519 | B2 * | 7/2011 | Chen | A47B 9/14 135/140 |
| 9,839,807 | B2 * | 12/2017 | Golesh | A63B 21/00069 |
| 9,919,182 | B2 * | 3/2018 | Golesh | A63B 21/0051 |
| 2011/0278404 | A1 * | 11/2011 | Hanlon | B66F 1/06 248/161 |

* cited by examiner

*Primary Examiner* — Steven M Marsh

(57) ABSTRACT

A position adjusting device for exercising apparatus includes a first frame body and a second frame body that are relatively displaceable in a longitudinal direction. A pressing member and a control assembly are respectively disposed at opposite sides of the first frame body. The control assembly has an axle portion and a deflection portion with an elastically extendable distance therebetween. At least one connecting arm connects the deflection portion and the pressing member. The control assembly is rotatable about the axle portion, so that the deflection portion is movable from a first position through a second position to a third position. When the deflection portion is in the first position, the distance is between a maximum length and a minimum length. When the deflection portion is in the second position, the distance is the minimum length. When the deflection portion is in the third position, the distance is the maximum length.

19 Claims, 12 Drawing Sheets

POSITION ADJUSTING DEVICE FOR EXERCISING APPARATUS

BACKGROUND

1. Field of the Invention

The present invention relates to an exercising apparatus. More particularly, the present invention relates to a position adjusting device for exercising apparatus for manually adjusting a relative position.

2. Description of the Related Art

In daily life and various fields, position adjusting devices are often used for allowing a user to manually adjust relative positions. For indoor exercising apparatuses, the seat assembly of upright exercise bike is generally available for allowing the user to adjust the vertical position of the seat, and the seat assembly of recumbent exercise bike is available for allowing the user to adjust horizontal position of the seat. The relative positions of the conventional position adjusting devices are generally locked by latching means or clamping means. The position adjusting device lock by latching means (for example, use a lock pin on the first frame body inserted into one of positioning holes in the second frame body) may not be detached from the selected position in the lock state, but there are still gaps between the first frame body and the second frame body so it may be slightly loose. In contrast, the position adjusting device lock by clamping means (for example, use a so-called "quick release" on the first frame body to secure the second frame body) may not remain any gap between the two frame bodies in the lock state, but it may be easy to get loose accidentally when sustaining great weight.

Of course, if a conventional latching lock mechanism and a conventional clamping lock mechanism are both arranged on a position adjusting device, the position adjusting device can be locked by both latching lock mechanism and clamping lock mechanism at the same time, and the advantages of the two lock mechanisms could be obtained. However, two separated sets of lock mechanisms attached on one position adjusting device means two set of independent actions have to be operated, which is troublesome to operate.

SUMMARY

The present invention is directed to a position adjusting device for exercising apparatus for manually adjusting a relative position, so that a user can quickly lock or release one frame body relative to the other frame body to adjust the vertical or horizontal position.

According to one aspect of the present invention, a position adjusting device for exercising apparatus comprises a first frame body and a second frame body each defining an adjusting direction and a locking direction which are substantially perpendicular to one another, the second frame body being movable relative to the first frame body along the adjusting direction, the first frame body and the second frame body each having a first side and a second side opposite to each other in the locking direction. The first side of the second frame body has at least one first pressurized surface extending in the adjusting direction, and the second side of the second frame body has a plurality of positioning holes equally spaced along the adjusting direction. A pressing member is disposed at the first side of the first frame body and located outside the at least one first pressurized surface of the second frame body for pressing the second frame body toward the second side of the first frame body and being movable between a first tightening position relatively close to the second side of the first frame body and a first loosening position relatively away from the second side of the first frame body. A control assembly is mounted at the second side of the first frame body, having an axle portion, a deflection portion, an elastic portion and a pushing portion, the deflection portion being farther from the pressing member than the axle portion, the elastic portion disposed between the deflection portion and the axle portion so that the distance between the deflection portion and the axle portion is variable between a maximum length and a minimum length, the elastic portion configured to provide an elastic restoring force for biasing the deflection portion away from the axle portion. At least one connecting arm has a first end and a second end opposite to each other, the first end coupled to the pressing member and the second end coupled to the deflection portion of the control assembly. A latching assembly is mounted on the second side of the first frame body, having an abutting portion and the positioning portion, the latching assembly being movable between a lock position where the positioning portion is inserted into one of the positioning holes of the second frame body and a release position where the positioning portion is not inserted into any position holes. An elastic member is mounted between the first frame body and the latching assembly for being configured to bias the latching assembly to the lock position.

Under this arrangement, the control assembly is deflectable about the axle portion so that the deflection portion is able to move from a first position through a second position and a third position to a fourth position; when the deflection is located at the first position, the distance between the deflection portion and the axle portion is a specific length between the maximum length and the minimum length, and the pressing member is located at the first tightening position; when the deflection portion is located at the second position, the distance between the deflection portion and the axle portion is the minimum length, and the pressing member is located at the first tightening position; when the deflection portion is located at the third position, the distance between the deflection portion and the axle portion is greater than the specific length, and the pressing member is located at the first loosening position; and when the deflection portion is located at the fourth position, the pushing portion of the control assembly abuts against the abutting portion of the latching assembly and pushes the latching assembly to the release position.

Preferably, the second side of the second frame body has at least one second pressurized surface extending in the adjusting direction. The control assembly further has a pressing portion configured to press the second frame body toward the first side of the first frame body and together with the axle portion to be movable between a second tightening position relatively close to the first side of the first frame body and a second loosening position relatively away from the first side of the first frame body. When the deflection portion of the control assembly is located at the first position or the second position, the pressing portion is located at the second tightening position; and when the deflection portion of the control assembly is located at the third position, the pressing portion is located at the second loosening position.

Preferably, the first frame body has a first side wall at the first side and located outside the at least one first pressurized surface of the second frame body. The first frame body has a first aperture through the first side wall. The pressing member is embedded in the first aperture and movable along the locking direction. When the pressing member is located at the first tightening position, the pressing member is projected toward the first side of the second frame body from an inner side surface of the first side wall.

Preferably, the first frame body has a second side wall at the second side and located outside the at least one second pressurized surface of the second frame body. The second frame body has a second aperture through the second side wall and defining two parallel edges. The control assembly has a cylindrical member partially engaged in the second aperture and movable along the locking direction. The cylindrical member has a semi-cylindrical surface and an axis of the semi-cylindrical surface is parallel to the two edges of the second aperture. Part of the control assembly corresponding to the axis of the semi-cylindrical surface is defined as the axle portion, and part of the semi-cylindrical surface forms the pressing portion. When the pressing portion is located at the second tightening position, the semi-cylindrical surface abuts against two edges of the second aperture, and the part of the semi-cylindrical surface as the pressing portion is projected toward the second side of the second frame body from an inner side surface of the second side wall.

Preferably, the position adjusting device further comprises four wedge blocks each having an inclined surface. Two wedge blocks are arranged in between the pressing member and the at least one first pressurized surface for pressing the at least one first pressurized surface with the inclined surface as the pressing member is moved to the first tightening position, and the other two wedge blocks are arranged in between the pressing portion of the control assembly and the at least one second pressurized surface with the inclined surface as the pressing portion is moved to the second tightening position. The inclined surfaces of the four wedge blocks face toward the second frame body in different directions.

Further benefits and advantages of the present invention will become apparent after a careful reading of the detailed description with appropriate reference to the accompanying drawings.

DETAIL DESCRIPTION

The present invention can be used as an adjusting device for manually adjusting a relative position in various fields. Hereinafter, a stationary bike is one of indoor exercising apparatuses that is taken as an example of application to describe in detail a possible embodiment of the present invention.

Figure 1:
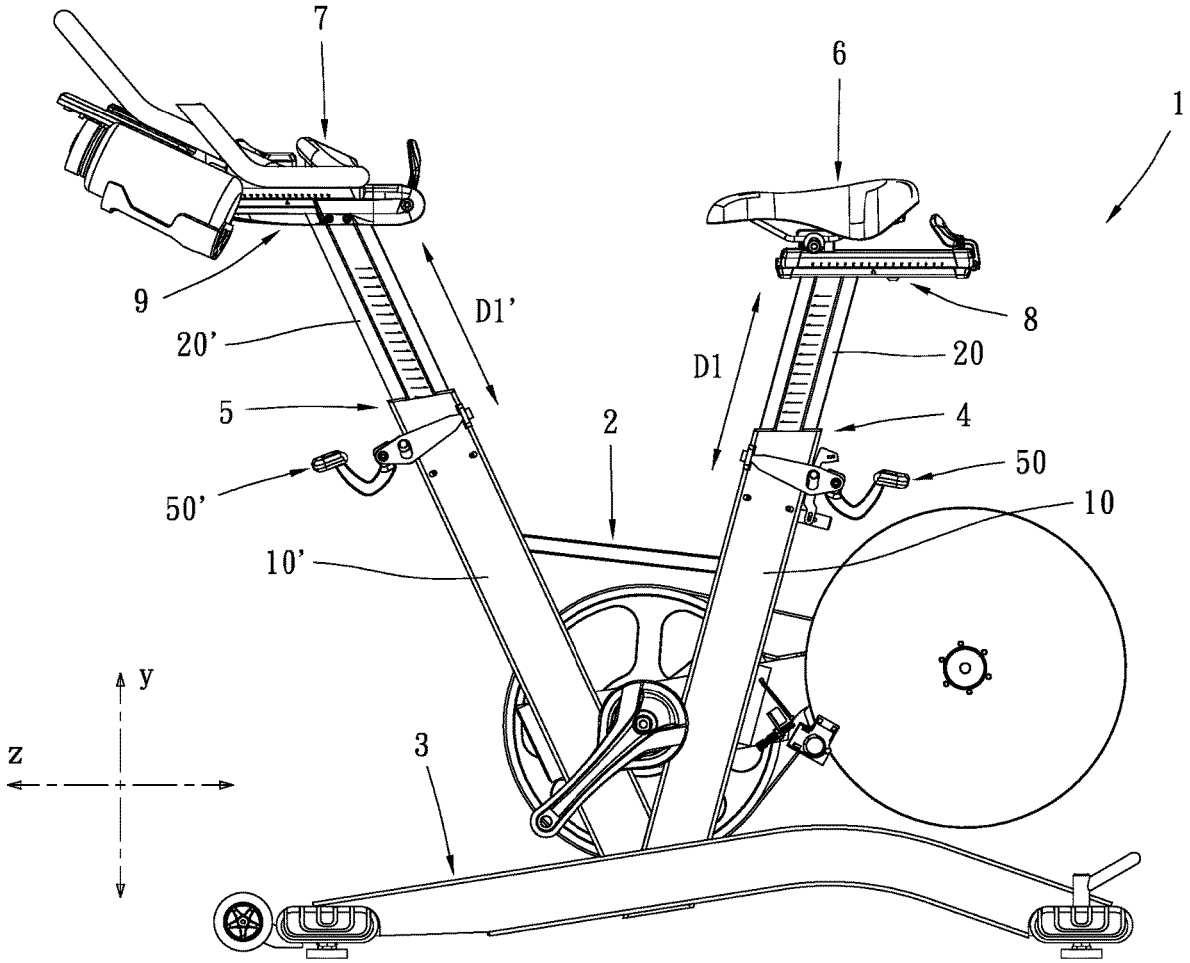
FIG. 1 is a side view of a stationary bike including position adjusting devices in accordance with a first embodiment and a second embodiment of the present invention.

FIG. 1 shows a stationary bike 1 including two position adjusting devices in accordance with a first preferred embodiment and a second preferred embodiment of the present invention. The stationary bike 1 has a frame assembly 2 that includes a base 3 adapted to rest on a ground, a first position adjusting device 4 according to the first embodiment and a second position adjusting device 5 according to the second embodiment. The first position adjusting device is configured for supporting a saddle 6 of the stationary bike 1 for allowing the user to adjust the vertical height of the saddle 6. The second position adjusting device is configured for supporting a handle set 7 of the stationary bike 1 for allowing the user to adjust the vertical height of the handle set 7. In brief, each of the two position adjusting devices 4, 5 includes a tube-shaped first frame body 10, 10' fixed on the base 3 and a tube-shaped second frame body 20, 20' telescopically mounted within one end of the first frame body 10, 10' so that the second frame body 20, 20' is able to extend upward or downward relative to the first frame body 10, 10' along the axial direction of the first frame body 10, 10'. The user is able to pull a control assembly 50, 50' at the top of the first frame body 10, 10' to different angles for locking the second frame body 20, 20' at the current height or releasing the second frame body 20, 20' to allow the second frame body 20, 20' to move up or down.

Referring to FIG. 1, the coordinate system at the lower left corner indicates the vertical axis (y-axis) and the front-rear axis (z-axis) of the stationary bike 1. The saddle 6 and the handle set 7 are respectively mounted on the second frame bodies 20, 20' of the first position adjusting device 4 and the second position adjusting device 5. The saddle 6 provided for allowing a user to sit on is movable along an adjusting direction D1 which is substantially vertical and slightly inclined to the rear, namely when the saddle 6 moves up/down, it also moves backward/frontward correspondingly. In contrast, the handle set 7 provided for allowing a user to hold is movable along an adjusting direction D1' which is substantially vertical and slightly inclined to the front, namely when the handle set 7 moves up/down, it also moves forward/backward correspondingly. Furthermore, the saddle 6 is mounted on the top end of the second frame body 20 of the first position adjusting device 4 through a horizontal position adjusting device 8 so that the saddle 6 is able to move horizontally along the front-rear axis (z-axis) relative to the second frame body 20 and being locked. Similarly, the handle set 7 is mounted on the top end of the second frame body 20' of the second position adjusting device 5 through another horizontal position adjusting device 9 so that the handle set 7 is able to move horizontally along the front-rear axis (z-axis) relative to the second frame body 20' and being locked. Therefore, every user of the stationary bike 1 can respectively adjust the paddle 6 and the handle set 7 to a suitable position according to the individual body type and habit such that the user is able to perform the exercise in a correct and comfortable manner.

Figure 2:
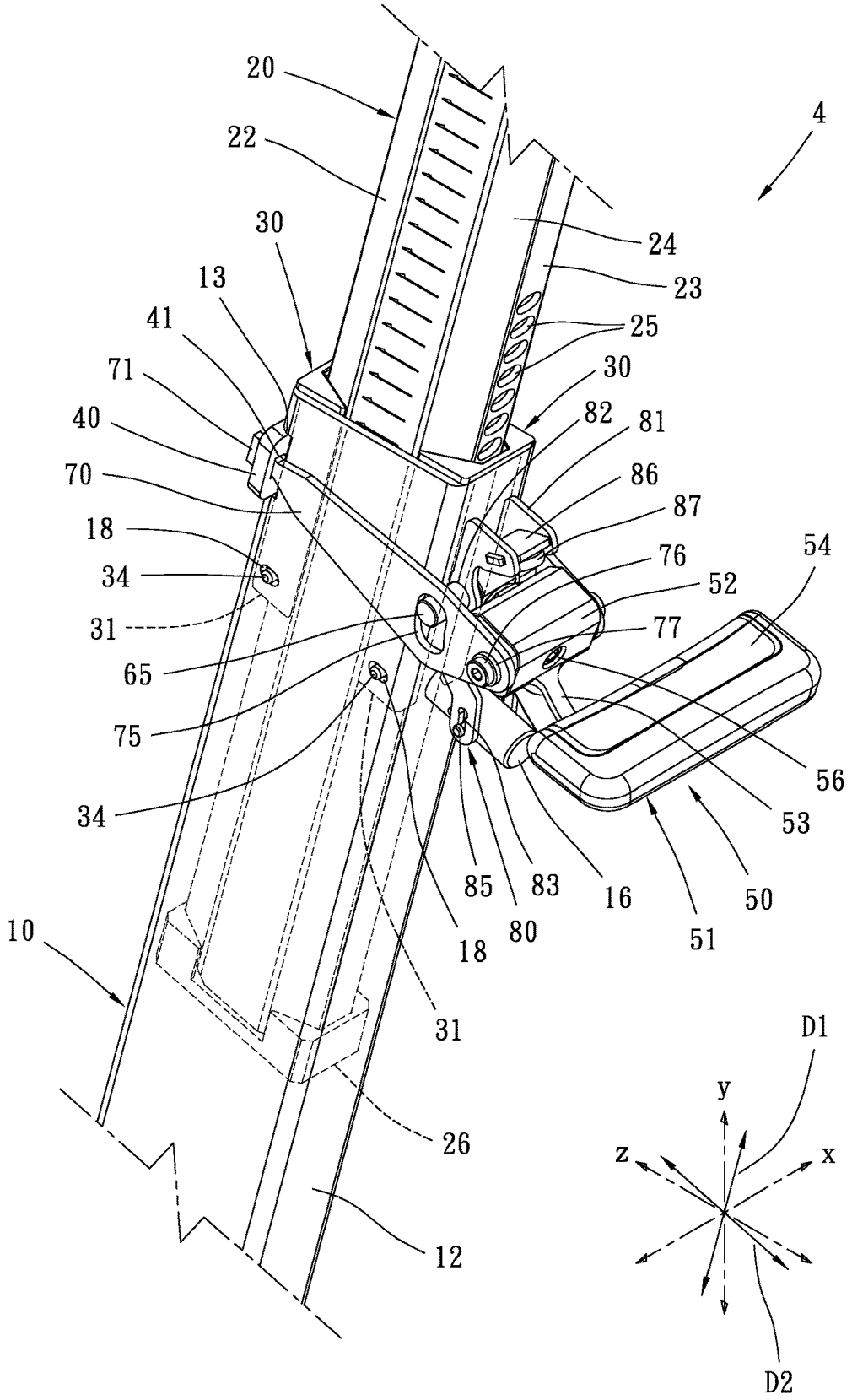
FIG. 2 is a perspective view of the position adjusting device of the first embodiment.
Figure 3:
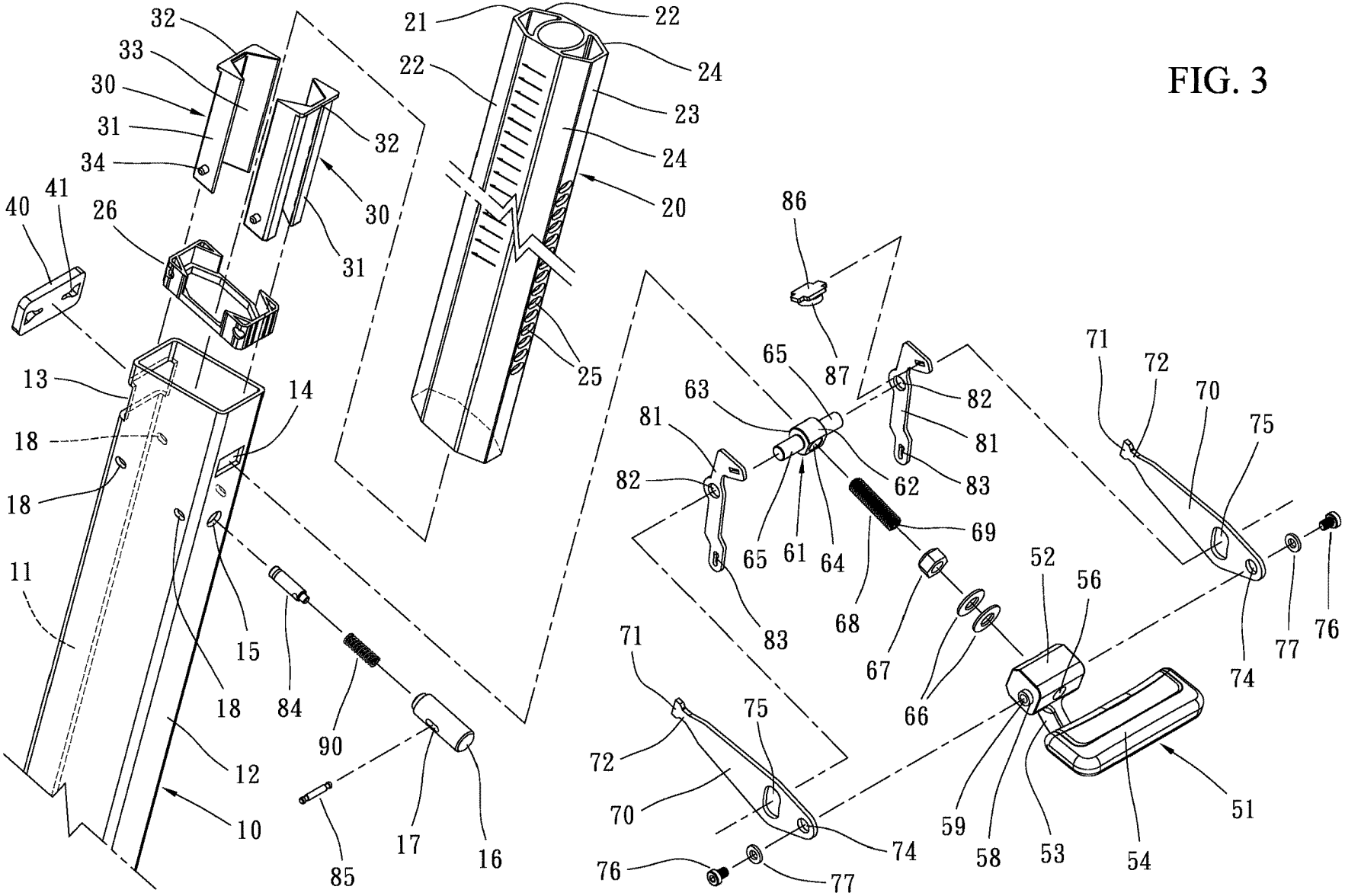
FIG. 3 is a exploded perspective view of the position adjusting device of the first embodiment.

Referring to FIG. 2 and FIG. 3, the first frame body 10 and the second frame body 20 of the first position adjusting device 4 together form a common telescopic mechanism. The first frame body 10 is a straight metal tube formed by a tubular section of substantially square or rectangular shape, and it adopts a square steel tube in the present embodiment. As shown in FIG. 1, the bottom end of the first frame body 10 is fixed to the base 3 of the stationary bike 1 (as shown in FIG. 1) and the top end of the first frame body 10 is located at the upper rear relative to the bottom end. In other words, the longitudinal axis of the first frame body 10 is an oblique line extending upward and rearward from the bottom. The second frame body 20 is a straight metal tube formed by a tubular section of substantially octagon shape, and it adopts aluminum extrusion tube in the present embodiment. The longitudinal axis of the second frame body 20 corresponds with the longitudinal axis of the first frame body 10. The second frame body 20 is partially inserted into the hollow interior of the first frame body 10 and is movable along the longitudinal axis of the first frame body 10. Within a preset range, the bottom end of the second frame body 20 remains in the interior of the first frame body 10 and the top end of the second frame body 20 remains outside the first frame body 10, and the top end of the second frame body 20 is provided with the horizontal position adjusting device 8 for supporting the saddle 6 (as shown in FIG. 1). The longitudinal direction of the first frame body 10 and the second frame body 20, namely the direction in which the second frame body 20 moves up and down relative to the first frame body 10, is defined as the adjusting direction D1. In the preferred embodiment of the present invention, the adjusting direction D1 corresponds to a substantially longitudinal straight line, but in another embodiment (not shown), the direction or moving path in which the second frame body moves relative to the first frame body may be horizontal or curved.

The first frame body 10 has four side walls that extended lengthwise along the longitudinal direction/adjusting direction D1, including a front side wall 11 and a rear side wall 12 which are parallel and opposite to each other, and a left side wall and a right side wall. In the embodiment described herein, the side where the front side wall 11 is located is referred to as a first side and the side where the rear side wall 12 is located is referred to as a second side. Referring to the coordinate system at the lower right corner in FIG. 1, the vertical direction of the first side and the second side is defined as a locking direction D2 which is perpendicular to the adjusting direction D1 and located in the same y-z plane. In the common concept of the present invention, the first side and the second side of the frame body indicate two predetermined sides in a direction (namely the locking direction) perpendicular to the adjusting direction. When the adjusting direction is along arc path, the locking direction is perpendicular to the tangent of the adjusting direction. As the foregoing adjusting direction may be various predetermined directions, the locking direction may also be various predetermined directions.

The first frame body 10 has a first aperture 13 in the front side wall 11 at the top thereof. The first aperture 13 is substantially rectangular with left and right sides respectively extended to the outer sides of the left side wall and the right side wall of the first frame body 10. In contrast, the rear side wall 12 has a second aperture 14 which is substantially rectangular with smaller size and defines parallel upper and lower edges. The rear side wall 12 further has a circular via hole 15 below the second aperture 14. A cylindrical member 16 is coaxially aligned with the via hole 15 and fixed to the outside of the rear side wall 12. The hollow interior of the cylindrical member 16 communicates with the hollow interior of the first frame body 10 through the via hole 15. The left and right sides of the periphery wall of the cylindrical member 16 each has a slot 17 extending in the axial direction. Both the left side wall and the right side wall of the first frame body 10 have front and rear buckling holes 18 substantially at a height corresponding to the height of the cylindrical member 16. Each of the buckling holes 18 is substantially oblong in shape such that the width in the locking direction D2 is slightly greater than the width in the adjusting direction D1.

Figure 9:
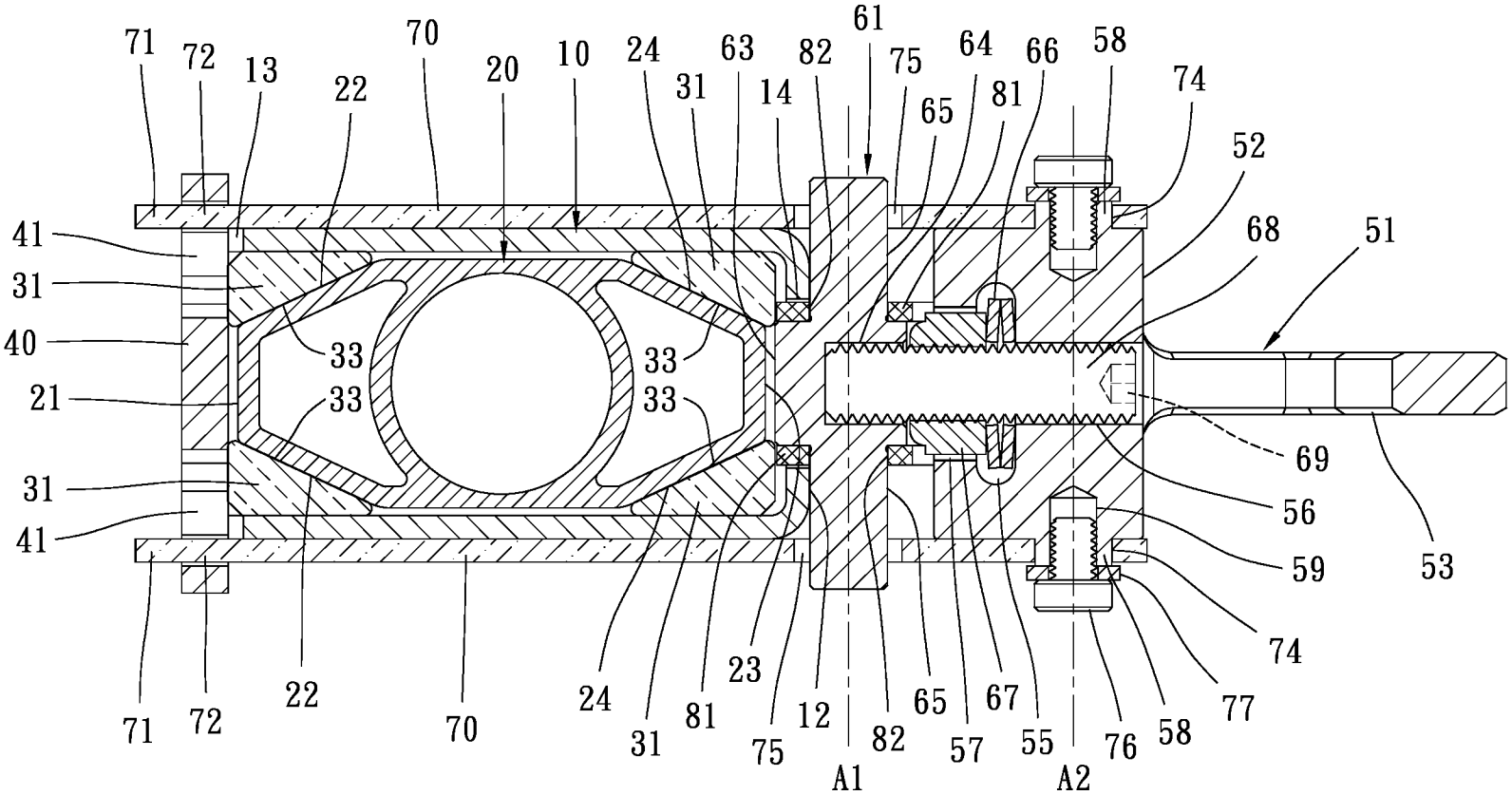
FIG. 9 is a cross-sectional view along line IX-IX of FIG. 8.

The second frame body 20 defines a first side surface 21 at its front side (referred to as first side) and a second side surface 23 at its rear side (referred to as second side). The first side surface 21 and the second side surface 23 extend along the adjusting direction D1. Besides, the first side of the second frame body 20 has two first pressurized surfaces 22 extending in the adjusting direction D1 and being adjacent to the left side and the right side of the first side surface 21 respectively. The second side of the second frame body 20 has two second pressurized surfaces 24 extending in the adjusting direction D1 and being adjacent to the left side and the right side of the second side surface 23. The first pressurized surfaces 22 and the second pressurized surfaces 24 are all planar. The distance between the two first pressurized surfaces 22 is gradually enlarged from the first side surface 21 in the direction away from the first side surface 21. Symmetrically, the distance between the two second pressurized surfaces 24 is gradually enlarged from the second side surface 23 in the direction away from the second side surface 23. Within the first frame body 10, the first side surface 21 and the second side surface 23 of the second frame body 20 respectively abut against the inner sides of the front side wall 11 and the rear side wall 12 of the first frame body 10, and at the same time the four pressurized surfaces 22, 24 of the second frame body 20 respectively substantially face the four inner corners of the first frame body 10, as shown in FIG. 9. Each of the pressurized surfaces 22, 24 is arranged in oblique relationship with the four side walls of the first frame body 10. The second frame body 20 has a plurality of positioning holes 25 equally spaced in the second side surface 23 along the adjusting direction D1. Each positioning hole 25 passes through the second side surface 23 in the locking direction D2 into the interior of the second frame body 20. The via hole 15 in the rear side wall of the first frame body 10 is aligned with the alignment of the positioning holes 25 of the second frame body 20.

Figure 4:
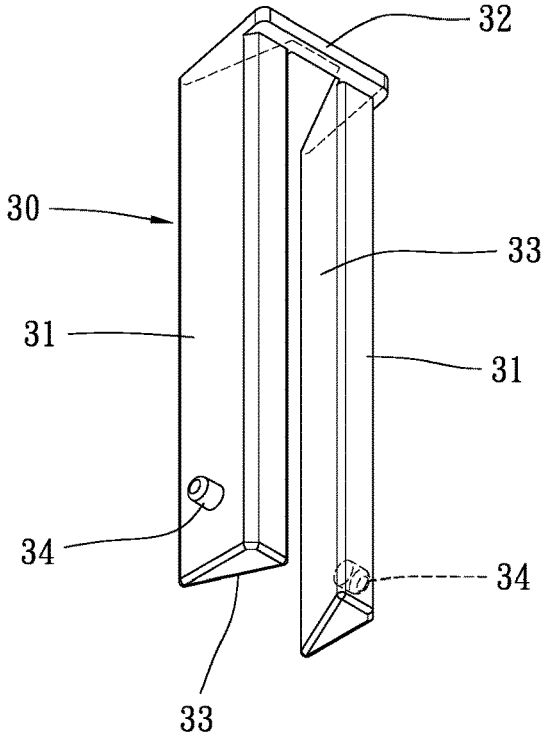
FIG. 4 is a perspective view of a bushing member of the first embodiment.

In order to assure a correct shape coupling between the first frame body 10 and the second frame body 20, it is provided that two opposite bushing members 30 are inserted in the top end of the first frame body 10 and disposed in between the first frame body 10 and the second frame body 20. Referring to FIG. 4, each bushing member 30 is integrally molded by plastic injection, which has two wedge blocks 31 spaced apart from each other and a connecting rib 32 transversely connecting the two wedge blocks 31. The two bushing members 30 have four wedge blocks 31 respectively located in the four corners of the first frame body 10. Each wedge block 31 extends downwards in the adjusting direction D1 from the top edge of the first frame body 10, and the cross-sectional outline of which is a right triangle. In other words, each wedge block 31 has two side surfaces perpendicular to each other and an inclined surface 33 connecting the two side surfaces. One side surface of each wedge block 31 abuts against the inner side of the front side wall 11 or the rear side wall 12 in parallel and partially exposed in the first aperture 13 of the front side wall 11 or the second aperture 14 of the rear side wall 12; the other side surface of each wedge block 31 abuts against the inner side of the left side wall or the right side wall; and at the same time, the inclined surface 33 of each wedge block 31 substantially abuts against the corresponding pressurized surface 22/24 of the second frame body 20. The connecting rib 32 of each bushing member 30 is extended from the corresponding right angle portion of the top edge of one wedge block 31 along the left-right axis (x-axis) to the corresponding right angle portion of the top edge of another wedge block 31. Besides, the connecting rib 32 is able to hang on the top edge of the front side wall 11 or the rear side wall 12. Moreover, the left side surfaces of the left wedge blocks 31 and the right side surfaces of the right wedge blocks 31 each has an outward projection 34 at the lower portion of each wedge block 31, suitable to engage at the respective buckling hole 18 in the left side wall or the right side wall of the first frame body 10, and the projection 34 of the respective wedge block 31 is able to slightly move within the respective buckling hole 18 along the locking direction D2. Therefore, each bushing member 30 is able to be positioned substantially at the top of the first frame body 10, and basically does not allow displacement in the adjusting direction D1 or the left-right axis (x-axis) but allow slightly displacement in the locking direction D2.

The two wedge blocks 31 of the bushing member 30 at the first side are respectively located at the left and right sides of the first side surface 21 of the second frame body 20. The two wedge blocks 31 of the bushing member 30 at the second side are respectively located at the left and right sides of the second side surface 23 of the second frame body 20, and located respectively at the left and right sides of the via hole 15 in the rear side wall 12 of the first frame body 10, that is, the wedge blocks 31 at the second side do not cover the positioning holes 25 of the second frame body 20 and do not cover the via hole 15 of the first frame body 10.

The bottom end of the second frame body 20 is located below the bushing members 30 and is fixed with a plastic stop member 26 with substantially rectangular cross-section. The stop member 26 has four sides substantially abutting against the inner sides of the four side wall of the first frame body 10. As shown in FIG. 2, the four corners of the stop member 26 respectively protrude outside the four pressurized surfaces 22, 24 of the second frame body 20. Therefore, when the second frame body 20 is extended upward from the top opening of the first frame body 10 by a predetermined length, the top surfaces of the four corners of the stop member 26, respectively abut against the bottom surfaces of the four wedge blocks 31 for prohibiting the bottom end of the second frame body 20 out of the interior of the first frame body 10.

The four side surfaces of the stop member 26 respectively substantially abut against the four inner side surfaces of the first frame body 10, and the inclined surfaces 33 of the four wedge blocks 31 respectively substantially abut against the four pressurized surfaces 22, 24 of the second frame body 20, so that the second frame body 20 is able to be moved along the adjusting direction D1 steadily. The bushing member 30 and the stop member 26 are made of plastic material, which can make the second frame body 20 move more smoothly and avoid noise and scratches caused by metal friction.

Figure 6:
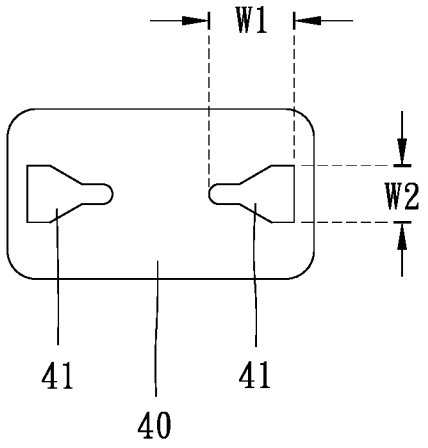
FIG. 6 is a front view of a pressing member of the position adjusting device of the first embodiment.

Referring to FIG. 2 and FIG. 3, a pressing member 40 is sized and shaped to cover the first aperture 13 in the front side wall 11 of the first frame body 10. The pressing member 40 is a metal plate with a plate surface parallel to the front side wall 11 of the first frame body 10, and the shape of the plate surface is substantially rectangular with a longer length in the horizontal direction. The pressing member 40 has a top edge and a bottom edge respectively abut against the upper edge and the lower edge of the first aperture 13, and a left end and right end are respectively protruded from the left side wall and the right side wall of the first frame body 10 as shown in FIG. 2 and FIG. 9. The pressing member 40 is able to be slightly moved inward in a direction that passes through the first aperture 13 toward the rear side wall 12 (namely the locking direction D2). In other words, the pressing member 40 is able to be slightly movable between a first tightening position relatively close to the rear side wall 12 of the first frame body 10 and a first loosening position relatively away from the rear side wall 12 of the first frame body 10. The inner side of the pressing member 40 exceeds the inner side of the front side wall 11 of the first frame body 10, namely moved into the interior of the first frame body 10 and abutting against the left and right wedge blocks 31 of the bushing member 30 at the first side, at least when the pressing member 40 is in the first tightening position. Referring to FIG. 6, the pressing member 40 has left and right engaging holes 41 through two opposite side of the pressing member 40. The width of each engaging hole 41 in the long axis direction of the plate surface (hereinafter referred to as long axis width W1) is greater than the width in the short axis direction of the plate surface (hereinafter referred to as short axis width W2). The left end of the left engaging hole 41 and the right end of the right engaging hole 41 are respectively exposed outside the left side wall and the right side wall of the first frame body 10.

Figure 7:
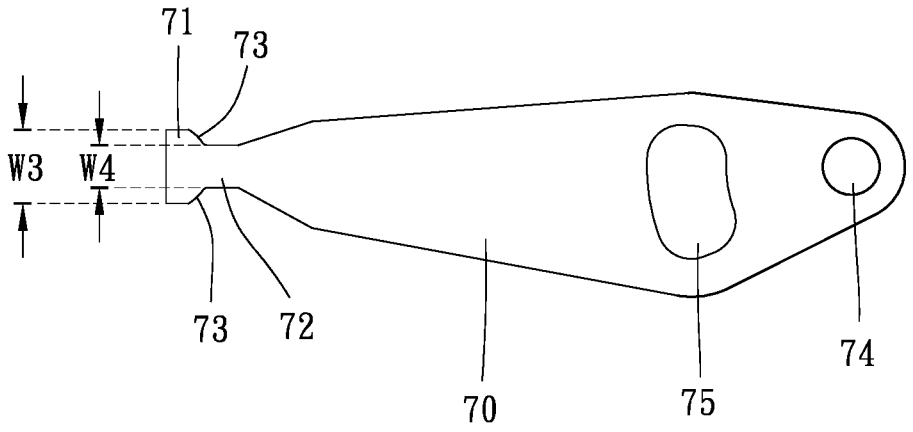
FIG. 7 is a side view of a connecting arm of the position adjusting device of the first embodiment.
Figure 10:
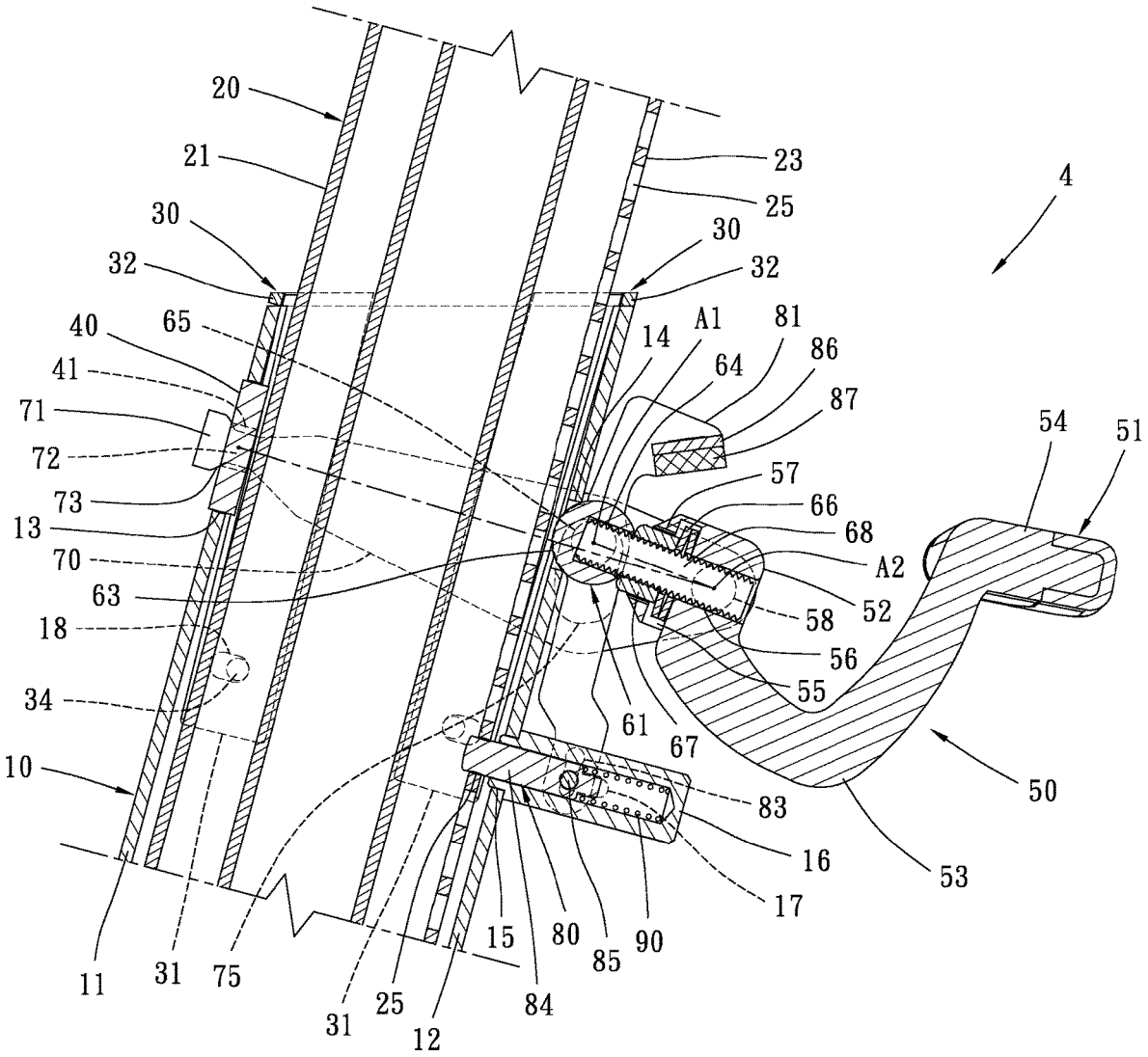
FIG. 10 is a longitudinal sectional view of the position adjusting device of the first embodiment, showing that a deflection portion of the control assembly is in a first position and a latching assembly is inserted into a positioning hole of a second frame body.

Two connecting arms 70 are provided on the left side and right side of the first frame body 10. Each of the two connecting arms 70 is a metal plate with a plate surface parallel to the left side wall/right side wall of the first frame body 10. Each connecting arm 70 is substantially strip-shaped, which has a first end (namely the front end in the present embodiment) and a second end (namely the rear end in the present embodiment) opposite to each other. Referring to FIG. 7, the first end of each connecting arm 70 has a head 71 at the front and a neck 72 behind the head 71, and the width of the head 71 (referred to as head width W3) is greater than the width of the neck 72 (referred to as neck width W4). The portion connected between the head 71 and the neck 72 defines upper and lower bevel edges 73 gradually slopping from the head 71 to the neck 72. Specifically, the head width W3 is smaller than the long axis width W1 of the engaging hole 41 but larger than the short axis width W2 of the engaging hole 41. The neck width W4 is smaller than the short axis width W2 of the engaging hole 41. On the other hand, the second end of each connecting arm 70 has a pivot hole 74 near the rear edge of the connecting arm 70 and limiting hole 75 located in front of the pivot hole 74. The limiting hole 75 is substantially oblong in shape, and its major axis is substantially perpendicular to the major axis of the connecting arm 70. The first ends of the left and right connecting arms 70 are respectively connected to the left and right ends of the pressing member 40. In detail, as shown in FIG. 10, the neck 72 of each connecting arm 70 is inserted in the corresponding engaging hole 41 of the pressing member 40 and the head 71 of the connecting arm 70 is stuck in front of the outer side of the pressing member 40 and cannot be pulled backward.

In operation, before embedding the pressing member 40 in the first aperture 13 of the first frame body 10, make the head 71 of the respective connecting arm 70 horizontally pass through the corresponding engaging hole 41 of the pressing member 40 and turn 90 degrees to make the head 71 get stuck in front of the engaging hole 41, and then embed the pressing member 40 in the first aperture 13 of the first frame body 10, such that the left and right connecting arms 70 respectively substantially abut against the left side wall and the right side wall of the first frame body 10 and cannot be turned and pulled away relative to the pressing member 40. Since the upper and lower bevel edges 73 of each connecting arm 70 respectively abut against the top edge and the bottom edge of the front opening of the respective engaging hole 41 of the pressing member 40, the backward movement of the connecting arms 70 will force the pressing member 40 to be displaced rearward in the locking direction D2. In addition, the second end of the respective connecting arm 70 can be limitedly pivoted up and down in y-z plane substantially about the neck 72 of the first end of the respective connecting arm 70. In another embodiment, the first ends of the connecting arms may be connected with the pressing member by another method.

Figure 8:
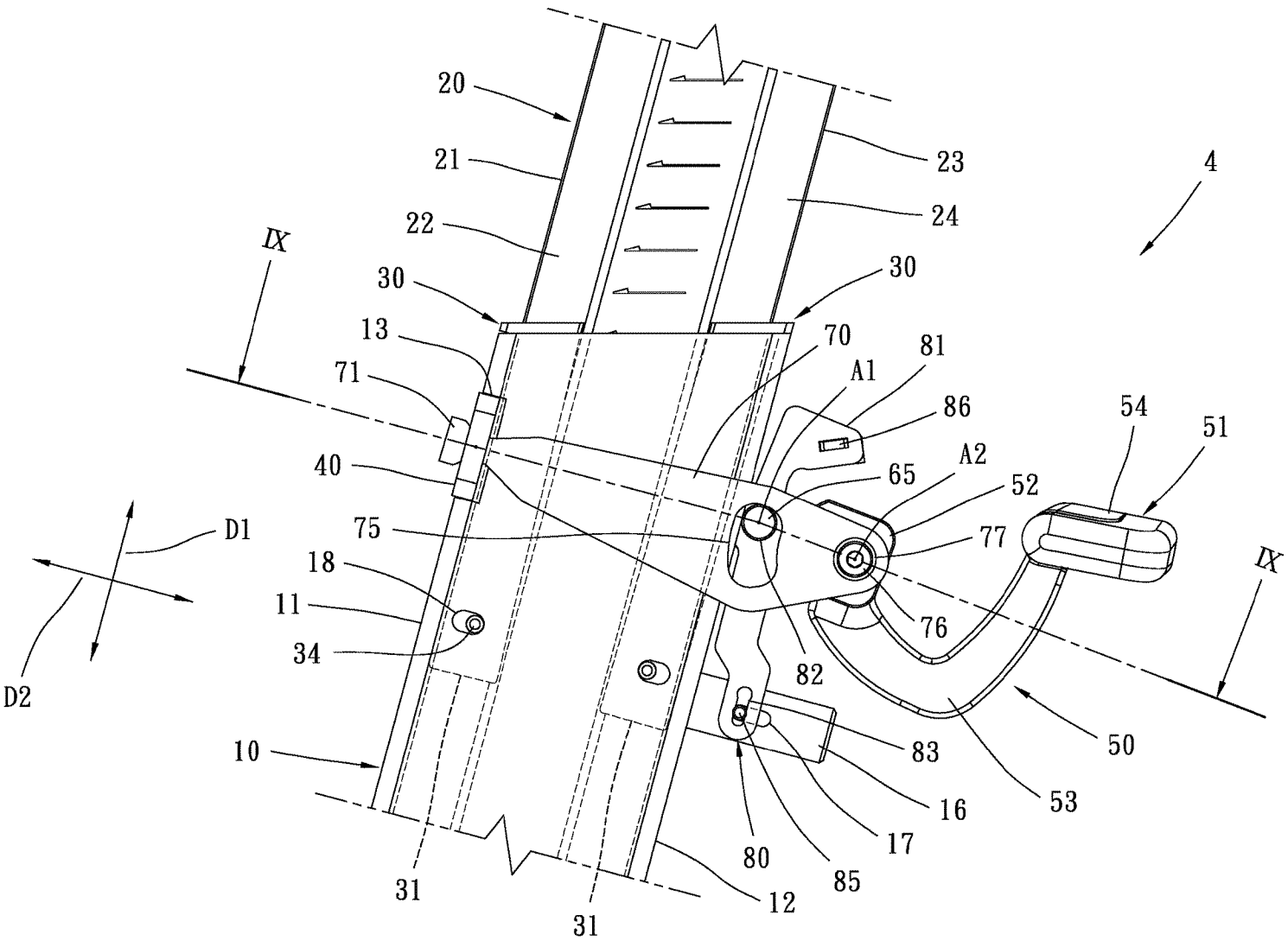
FIG. 8 is a side view of the position adjusting device of the first embodiment.

The control assembly 50 includes a main component 51, an axle component 61, two elastic washers 66, a hexagonal nut 67 and a screw bolt 68. The axle component 61 has a cylindrical member 62 substantially cylinder-shaped and two opposite axial shafts 65 respectively axially connected to the two end of the cylindrical member 62. In general, the axle component 61 is positioned at the rear side of the top end of the first frame body 10, and only the front side of the cylindrical member 62 is fitted into the second aperture 14 in the rear side wall 12 of the first frame body 10. In detail, the front half of the peripheral surface of the cylindrical member 62 forms a semi-cylindrical surface 63, and the axis of the semi-cylindrical surface 63 is parallel to the upper and lower edges of the second aperture 14 namely corresponding to the left-right axis (x-axis), and the diameter of the semi-cylindrical surface 63 is greater than the vertical width of the second aperture 14, so that the semi-cylindrical surface 63 could be forward to simultaneously abut against the upper and lower edges of the second aperture 14. The two axial shafts 65 are against the outer side of the rear side wall 12 of the first frame body 10 and respectively pass through the limiting holes 75 of the left and right connecting arms 70. The axis of the two axial shafts 65 is coaxial with the axis of the semi-cylindrical surface 63, defining a first axis A1, as shown in FIG. 8 and FIG. 9. The cylindrical member 62 also has a blind hole 64 in the rear side thereof, and the axis of the blind hole 64 perpendicularly intersects the first axis A1. The axle component 61 is able to be slightly moved inward in a direction through the second aperture 14 namely the locking direction D2. In other words, the axle component 61 is slightly movable between a second tightening position relatively close to the front side wall 11 of the first frame body 10 and a second loosening position relatively away from the first side wall 11 of the first frame body 10. In the preferred embodiment of the present invention, when the semi-cylindrical surface 63 of the axle component 61 abuts against both the upper and lower edges of the second aperture 14, the axle component 61 cannot move forward anymore, namely the axle component 61 is positioned at the second tightening position. The foremost end of the cylindrical member 62 of the axle component 61 (corresponding to a part of the semi-cylindrical surface 63) extends forward beyond the inner side of the rear side wall 12 of the first frame body 10, namely protruded into the interior of the first frame body 10 and abutting against the left and right wedge blocks 31 of the bushing member 30 at the second side, at least when the axle component 61 is in the second tightening position.

Figure 5:
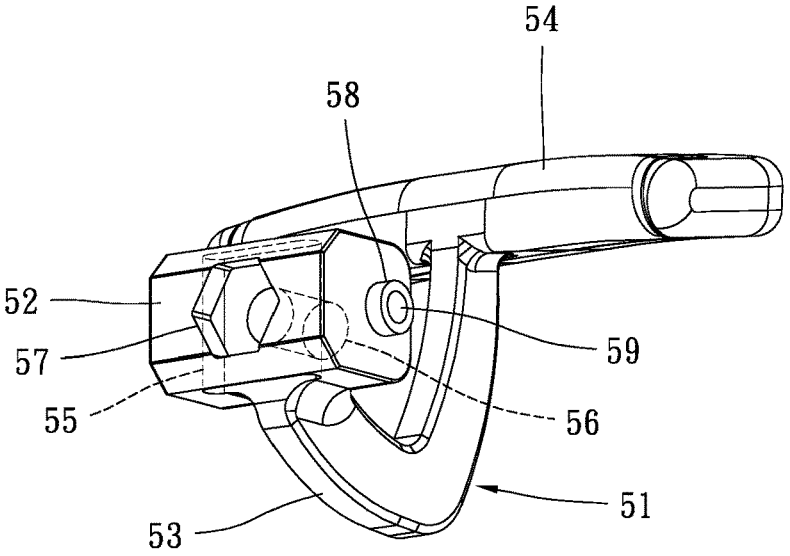
FIG. 5 is a perspective view of a main component of a control assembly of the position adjusting device of the first embodiment.

Referring to FIG. 5, the main component 51 has a substantially rectangular block body 52, a bent stem 53 extending rearward and upward from the bottom of the block body 52, and a horizontal handle 54 connected to the rear end of the bent stem 53. The main component 51 is entirely made of cast except that the handle 54 is partially covered with rubber. The block body 52 has a recess 55 that is concaved upward from the bottom of the block body 52, a through hole 56 defined in the rear side of the block body 52 and communicating with the recess 55, and a hexagonal hole 57 defined in the front side of the block body 52 and communicating with the recess 55 and aligned with the through hole 56. The main component 51 is located behind the axle component 61, and the through hole 56 of the main component 51 is coaxial with the blind hole 64 of the axle component 61. Referring to FIG. 9 and FIG. 10, the hexagonal nut 67 is embedded in the hexagonal hole 57 of the main component 51, so that the hexagonal nut 67 cannot rotate with respect to the main component 51 but can be moved in the axil direction. The two elastic washers 66 are coaxially overlapped and received in the recess 55 of the main component 51, and the central holes of the two washers 66 are aligned with the through hole 56. The screw bolt 68 passes forward through the through hole 56 of the main component 51, the two elastic washers 66 and the hexagonal nut 67, and then inserted into the blind hole 64 of the axle component 61 with the front end abutting against the bottom of the blind hole 64. The external thread of the screw bolt 68 does not interfere with the inner wall of the through hole 56 of the main component 51 and the inner wall of the blind hole 64 of the axle component 61, but screwed with the internal thread of the hexagonal nut 67. On the other hands, the block body 52 of the main component 51 has two protrusions 58 respectively projecting outwardly from the left and right sides of the block body 52. Each protrusion 58 has a screw hole 59 defined in the outer end thereof. The left side and the right side of the block body 52 are respectively substantially against the inner sides of the two connecting arms 70. The two protrusions 58 are respectively pivotally inserted into the pivot holes 74 of the two connecting arms 70, and each protrusion 58 is coupled with the corresponding connecting arm 70 by means of a screw 76 passing through a stop washer 77 and then locked into the screw hole 59 of the respective protrusion 58 of the block body 52, and the stop washer 77 is arranged at the outer side of the respective connecting arm 70 for preventing the respective protrusion 58 out of the pivot hole 74 of the respective connecting arm 70. The axis of the two protrusions 58 is coaxial with the axis of the two pivot holes 74 to define a second axis A2, as shown in FIG. 8 and FIG. 9. The main component 51 and the connecting arms 70 can be relatively pivoted about the second axis A2. The second axis A2 corresponds to the left-right axis (x-axis) and perpendicularly intersects the axis of the through hole.

The two elastic washers 66 are sandwiched between the rear wall of the recess 55 of the main component 51 and the rear end surface of the hexagonal nut 67 with a predetermined axial deformation, that is, the two elastic washers 66 accumulate an elastic restoring force in the axial direction, and such elastic restoring force causes the main component 51 and the axel component 61 to have a tendency to move away from each other in the axial direction of the screw bolt 68. The screw bolt 68 has a hexagonal hole 69 defined in the rear end thereof. If necessary, it is able to use an Allen wrench to twist the screw bolt 68 through the through hole 56 to force the hexagonal nut 67 forward or backward relative to the screw bolt 68 in the axial direction, in order to adjust the pre-deformation degree of the elastic washers 66.

Based on the aforementioned structure, a portion of the control assembly 50 corresponding to the axis of the semi-cylindrical surface 63 of the axle component 61 namely the first axis A1 forms an axle portion; a portion of the control assembly 50 corresponding to the axis of the protrusions 58 of the main component 51 namely the second axis A2 forms a deflection portion; and a top surface of the block body 52 of the main component 51 forms a pushing portion. The control assembly 50 can be pivoted about the axle portion so that the deflection portion and the pushing portion are movable to different positions. Additionally, the control assembly 50 further has an elastic portion disposed between the deflection portion and the axle portion. In the present embodiment, the elastic portion is constituted by the two elastic washers 66. Therefore, the elastic portion allows the distance between the deflection portion and the axle portion to be variable between a maximum length and a minimum length. The elastic portion is configured to provide an elastic restoring force for biasing the deflection portion away from the axle portion. Furthermore, a portion of the control assembly 50 corresponding to the foremost end of the axle component 61 forms a pressing portion. The pressing portion is configured to press the second frame body 20 toward the first side of the first frame body 10 and together with the axle portion to be movable between a second tightening position relatively close to the first side of the first frame body 10 and a second loosening position relatively away from the first side of the first frame body 10. When the pressing portion is in the second tightening position, the pressing portion abuts against the left and right wedge blocks 31 of the bushing members 30 at the second side.

In the preferred embodiment of the present invention, the first position adjusting device 4 further comprises a latching assembly 80 disposed at the rear side of the top portion of the first frame body 10 as the control assembly 50. The latching assembly 80 has two lever members 81, a pin member 84, a through bolt 85, a connecting sheet 86 and a magnet 87. Each lever member 81 is a longitudinally elongated plat, having a pivot hole 82 between the upper end and the lower end, and an elongated hole 83 defined in the lower end. The two lever members 81 are respectively pivotally mounted on the left and right axial shafts 65 of the axle component 61 of the control assembly 50 through the pivot holes 82, so that the two lever members 81 is pivotable relative to the axle component 61 about the first axis A1. The portion of each lever member 81 in front of the pivot hole 82 matches the arc shape at the front end of the cylindrical member 62 of the axle component 61 and together with the cylindrical member 62 to be partially engaged in the second aperture 14 of the rear side wall 12 of the first frame body 10 and abutting against the left and right wedge blocks 31 of the bushing members 30, as shown in FIG. 9. The connecting sheet 86 is connected between the top ends of the left and right lever members 81 so that the two lever members 81 can be simultaneously pivoted together. The magnet 87 is fixed on the bottom of the connecting sheet 86 to form an abutting portion of the latching assembly 80 for temporary attracting the block body 52 of the main component 51 to facilitate operation. The abutting portion is located above the top surface of the block body 52 of the main component 51 of the control assembly 50 (namely above the pushing portion). The pin member 84 is received in the cylindrical member 16 at the rear side wall 12 of the first frame 10, and the axis of the pin member 84 corresponds to the axis of the cylindrical member 16 namely the locking direction D2. The pin member 84 is movable with respect to the first frame body 10 along the locking direction D2, and the front end of the pin member 84 forms a positioning portion of the latching assembly 80 that is able to be inserted into the interior of the first frame body 10 through the via hole 15 in the rear side wall 12 of the first frame body 10. The through bolt 85 passes through the pin member 84 along the left-right axial direction (x-axis). The left and right ends of the through bolt 85 are respectively protruded out of the periphery wall of the cylindrical member 16 via the slots 17 and respectively inserted into the elongated holes 83 of the left and right lever members 81, so that the movement of the pin member 84 and the movement of the two lever members 81 are correlated with each other. Specifically, an elastic member 90 (in the present embodiment, a helical compression spring) is received in the cylindrical member 16 and located behind the pin member 84. The elastic member 90 has two ends respectively abut against the cylindrical member 16 and the pin member 84, such that the pin member 84 is continuously pushed forward by the elastic member 90, which drives the lower end of the respective lever member 81 to move forward and the upper end to move backward.

Figure 13:
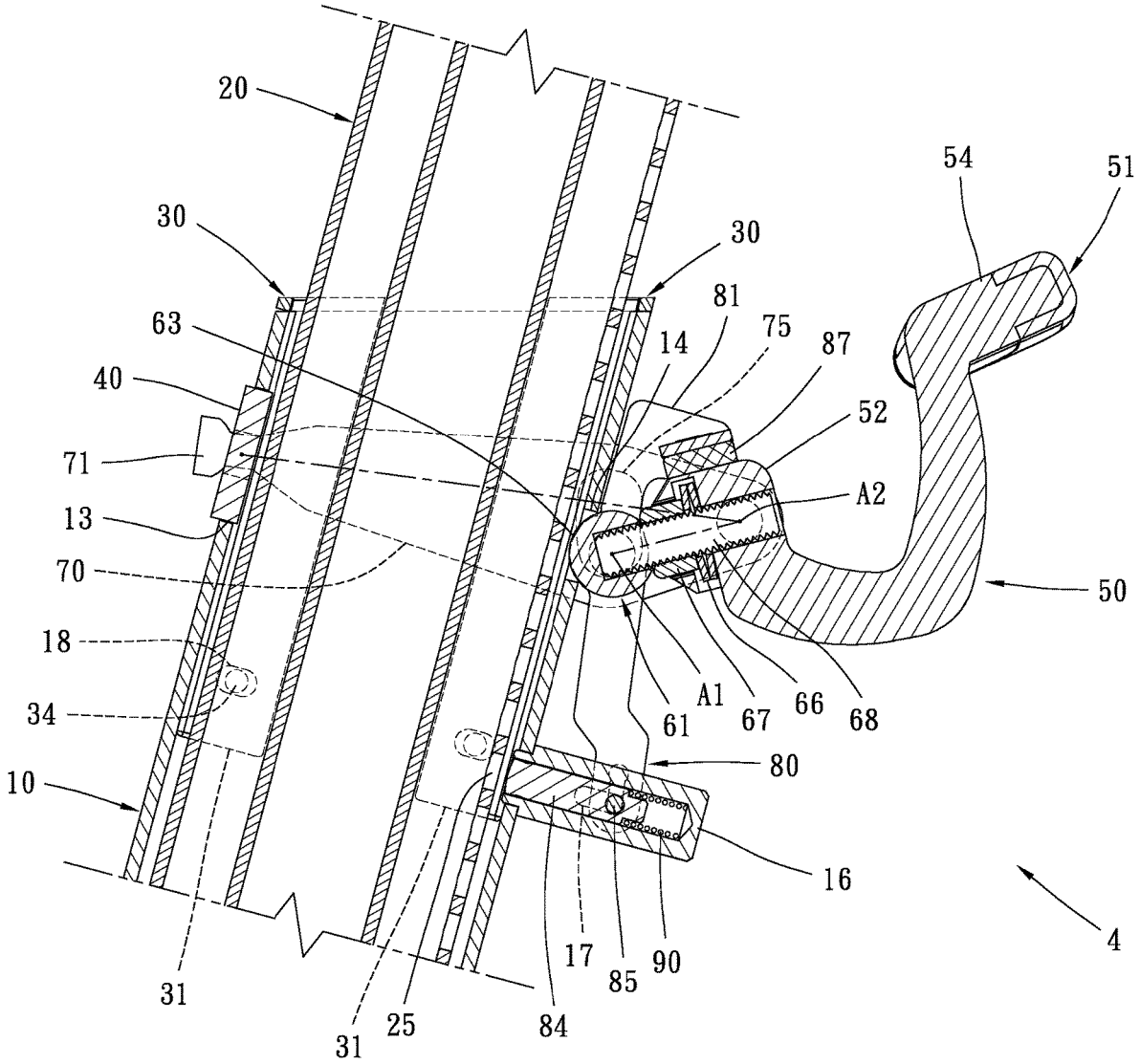
FIG. 13 is similar to FIG. 10, but showing that the deflection portion of the control assembly is in a fourth position.

The latching assembly 80 is movable between a lock position as shown in FIG. 10 and a release position as shown in FIG. 13. When the latching assembly 80 is in the lock position, the pin member 84 is located at the foremost position of the movable range (note: the through bolt 85 is stopped at the front end of the slot 17 of the cylindrical member 16), and the front end of the pin member 84 (namely the positioning portion) is inserted into one of the positioning holes 25 of the second frame body 20. In contrast, when the latching assembly 80 is in the release position, the pin member 84 is locate at the rearmost position of the movable range (note: the through bolt 85 is stopped at the rear end of the slot 17 of the cylindrical member 16), and the front end of the pin member 84 is drawn back to be substantially flush with the rear side wall 12 of the first frame body 10 and is not inserted into any position holes, even the pin member 84 does not touch the second side surface 23 of the second frame body 20. The elastic member 90 is configured provide a force applied to the pin member 84 for biasing the latching assembly 80 to the lock position.

Figure 11:
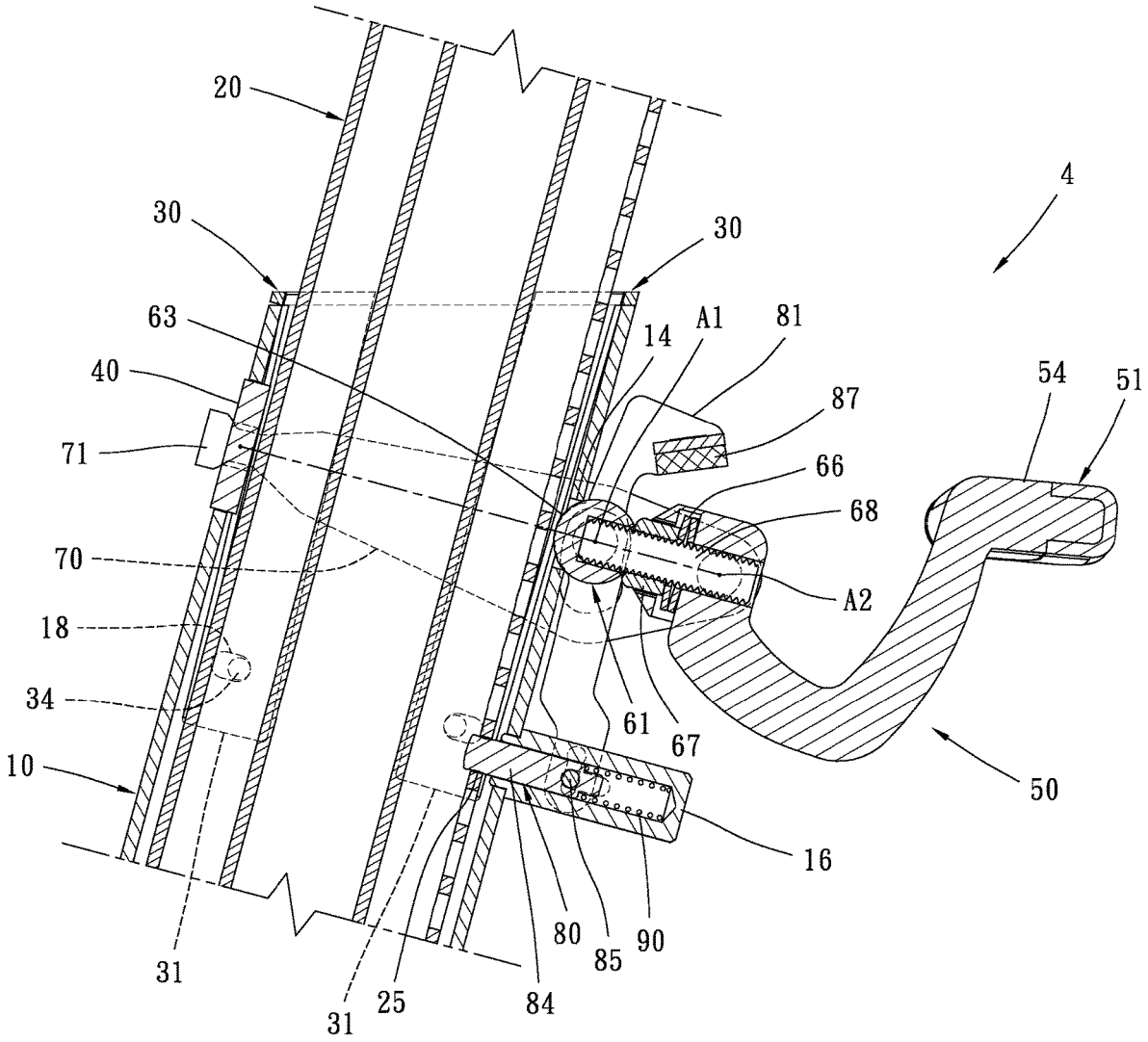
FIG. 11 is similar to FIG. 10, but showing that the deflection portion of the control assembly is in a second position.
Figure 12:
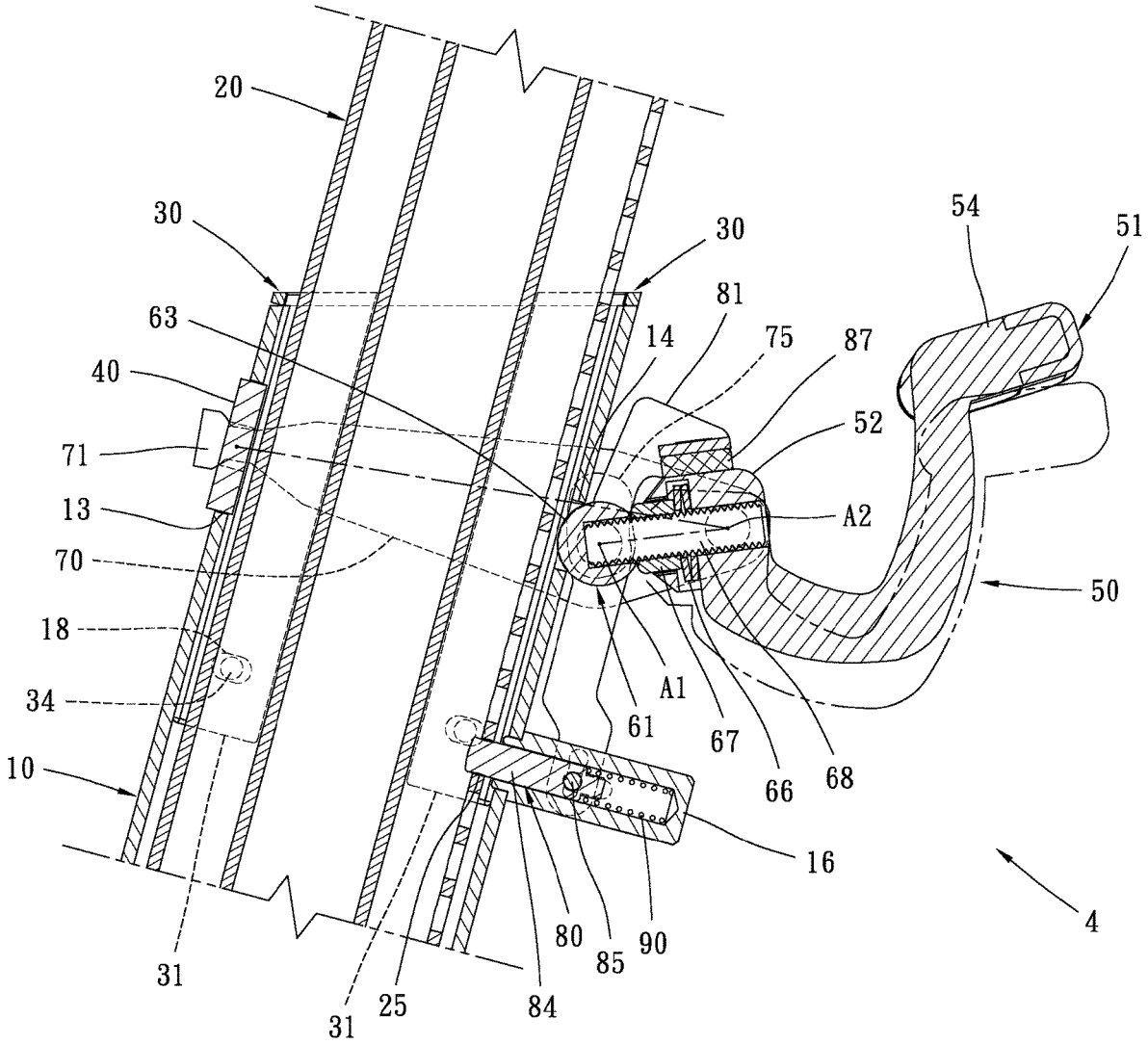
FIG. 12 is similar to FIG. 10, but showing that the deflection portion of the control assembly is in a third position.

As mentioned previously, the control assembly 50 is pivotable about the axle portion namely the portion corresponding to the first axis A1, so that the deflection portion namely the portion corresponding to the second axis A2 is movable to different positions. As shown in FIG. 10 through FIG. 13, the deflection portion is able to move with respect to the axle portion from a first position (as shown in FIG. 10) through a second position (as shown in FIG. 11) and a third position (as shown in FIG. 12) to a fourth position (as shown in FIG. 13), and vice versa. Generally, the deflection portion is movable along an arc-shaped reciprocating path with respect to the axle portion, and the first position and the fourth position can be regarded as two opposite ends of the reciprocating path. In the preferred embodiment, the control assembly 50 is operated from the first position to the fourth position in an upward direction, but in another embodiment, the operation direction may be reversed or in other predetermined direction. When rotating the control assembly 50, the deflection portion drives the left and right connecting arms 70 to rotate about the axle portion. Since the distance between the deflection portion and the front end of the respective connecting arm 70 is constant, when the angle of the deflection portion with respect to the axle portion is changed, the distance between the deflection portion and the axle portion could be slightly elongated or shortened based on the elasticity of the elastic portion, namely changed between the maximum length and the minimum length.

Referring to FIG. 10, when the control assembly 50 is rotated to a position that the deflection portion is in the first position, the connecting line between the deflection portion and the front end of the connecting arm 70 (note: the center of the neck 72 is taken as the end point) is located below the axle portion, and the distance between the deflection portion and the axle portion is a specific length between the maximum length and the minimum length. At this time, the aforementioned two elastic washers 66 sandwiched between the deflection portion and the axle portion are compressed and deformed to a predetermined degree (but have not yet reached the maximum deformation), and such elastic restoring force causes the deflection portion away from the axle portion namely the elastic restoring force of the two elastic washers 66 pushes the main component 51 backward and pushes the hexagonal nut 67 forward, such that the pressing member 40 at the first side of the first frame body 10 is stopped at the first tightening since the pressing member 40 is pulled backward by the elastic restoring force that pulls the connecting arms 70 backward, and the axle component 61 at the second side of the first frame body 10 is stopped at the second tightening position since the axle component 61 is pushed forward by the elastic restoring force that pushes the screw bolt 68 forward.

As shown in FIG. 8 and FIG. 10, when the deflection portion is in the first position, the left and right axial shafts 65 of the axle component 61 of the control assembly 50 respectively abut against the upper edges of the limiting hole 75 of the left and right connecting arms 70, so that the deflection portion of the control assembly 50 cannot be displaced from the first position in a direction away from the second position (namely moved downward in the present embodiment). However, the means for preventing the displacement of the deflection portion from the first position in the direction away from the second position is not limited by the present invention. As can be seen from the FIG. 8 and FIG. 10, as long as two of the control assembly 50, the connecting arm 70 and the first frame body 10 are interfered with each other, the deflection portion of the control assembly 50 cannot be moved downward continuously from the present position so as to achieve the same purpose.

Referring to FIG. 11, when the control assembly 50 is rotated to a position where the deflection portion is in the second position, the connecting line between the deflection portion and the front end of the connecting arm 70 passes through the axle portion (namely the three points are connected to form a straight line), and the distance between the deflection portion and the axle portion is the minimum length. In other words, the two elastic washers are compressed to the flattest state with largest accumulated elasticity. At this time, the pressing member 40 at the first side and the axle component 61 at the second side are respectively located at the first tightening position and the second tightening position as in the first position.

Referring to FIG. 12, when the control assembly 50 is rotated to a position where the deflection portion is in the third position, the connecting line between the deflection portion and the front end of the connecting arm 70 is located above the axle portion, and the distance between the deflection portion and the axle portion is greater than the specific length in the state shown in FIG. 10. At this time, the two elastic washers 66 are fully extended and uncompressed, so that there is no elastic force for pushing the main component 51 of the control assembly 50 and the axle component 61 away from each other. Therefore, the pressing member 40 is not pulled backward by the elastic restoring force that pulls the connecting arms 70 backward, and the axle component 61 is not pushed forward by the elastic restoring force that pushes the screw bolt 68 forward, so that the pressing member 40 is able to be movable forward from the first tightening position to the first loosening position, and the axle component 61 is able to be movable from the second tightening position to the second loosening position.

As shown in FIG. 12, the top surface of the block body 52 of the main component 51 of the control assembly 50 (namely the pushing portion) is just in contact with the bottom surface of the magnet 87 of the latching assembly 80 (namely the abutting portion) and the latching assembly 80 is still in the lock position. In fact, before the pushing portion contacts the abutting portion (as the position depicted in phantom line in FIG. 12), the elastic washers 66 may be fully extended so that the pressing member 40 and the axle component 61 can be loosened from the respective tightening position to the loosening position, that is, unlike the aforementioned first position and the second position, the third position is not a specific point on the reciprocating path, but it is able to be understand as one point in a specific section of the reciprocating path.

Referring to FIG. 13, when the control assembly 50 is rotated to a position where the deflection portion is in the fourth position, the pushing portion of the control assembly 50 abuts against the abutting portion of the latching assembly 80 and pushes the latching assembly 80 to the release position. In this state, since the distance between the deflection portion and the axle portion of the control assembly 50 is greater than that shown in FIG. 12, there is no elastic force for pushing the main component 51 of the control assembly 50 and the axle component 61 away from each other, so that the pressing member 40 and the axle component 61 are not limited in the first tightening position and the second tightening position.

In operation, when the first position adjusting device 4 is in the state shown in FIG. 10, the second frame body 20 is fully engaged by latching means and clamping means. In detail, the latching assembly 80 is in the lock position, and the front end of the pin member 84 (namely the positioning portion) is inserted into one of the positioning holes 25 at the second side of the second frame body 20, and the other part of the pin member 84 remains in the cylindrical member 16 at the second side of the first frame body 10. In other words, the pin member 84 is locked between the first frame body 10 and the second frame body 20 in the locking direction D2 so that the second frame body 20 cannot be movable along the adjusting direction D1. Because the latching assembly 80 is continuously biased by the elastic member 90 toward the lock position, the latching assembly 80 will not be released from the lock position unless a reverse and sufficient external force applies on the latching assembly 80.

On the other hand, the pressing member 40 of the first position adjusting device 4 is configured to press the second frame body 20 in a direction from the first side toward the second side, and the pressing portion of the control assembly 50 (namely the foremost portion of the axle component 61) is configured to press the second frame body in a direction from the second side toward the first side. In the preferred embodiment, the pressing member 40 and the pressing portion respectively press the second frame body 20 through the wedge blocks 31 of the bushing members 30. As shown in FIG. 9, the wedge blocks 31 at the front side are arranged in between the pressing member 40 and the respective first pressurized surfaces 22 of the second frame body 20, and the wedge blocks 31 press the respective first pressurized surfaces 22 by the respective inclined surfaces 33 as the pressing member 40 moves forward to the first tightening position. In contrast, the wedge blocks 31 at the second side are arranged in between the axle component 61 and the respective second pressurized surfaces 24 by the respective inclined surfaces 33 as the axle component 61 moves forward to the second tightening position. In the state shown in FIG. 10, the pressing member 40 at the first side and the axle component 61 at the second side are respectively located in the first tightening position and the second tightening position, and the four wedge blocks 31 are pressed inward and fixed by the pressing member 40 and the axle component 61 (and parts of the lever members 81) such that the four wedge blocks 31 are tightly congested in the four corners between the first frame body 10 and the second frame body 20 so as to further fix the second frame body 20. Based on the elastic effect of the elastic washers 66, the control assembly 50 in the state of FIG. 10 has a tendency to deflect downward and stopped at the angle shown in FIG. 10, and the pressing member 40 and the axle component 61 are positioned at respective tightening positions due to the elastic effect at the same time.

If the user wants to adjust the height of the saddle 6, the dual lock mechanism of the first position adjusting device 4 must be manually released, so that the second frame body 20 is able to be adjustable along the adjusting direction D1 to an appropriate height and then locked again. In operation, when releasing the lock mechanism, the user can pull the handle 54 of the control assembly 50 upward from the angle shown in FIG. 10 through the angle shown in FIG. 11 to the angle shown in FIG. 12 to release the clamping lock (namely the pressing member 40 and the axle component 61), and then rotating the control assembly 50 from the angle shown in FIG. 12 to the angle shown in FIG. 13 to release the latching lock. When relocking the lock mechanism, the user can operate in reverse action to lock the latching lock and the clamping lock, back to the state shown in FIG. 10.

In detail, when the user applies force to rotate the control assembly 50 upwardly from the angle shown in FIG. 10, the force must be able to further compress the two elastic washers 66 to shorten the distance between the deflection and the axle portion at the beginning until the angle shown in FIG. 11 (namely the elastic washers are compressed to the flattest state with shortest distance), and the elastic restoring force of the elastic washers 66 becomes an assistance force to help the control assembly 50 rotating upward until the elastic washers 66 are fully extended and the elastic effect between the deflection portion and the axle portion is disappeared, so that the pressing member 40 and the axle component 61 are movable from the respective tightening positions to the respective loosening positions and the wedge blocks 31 will not press the second frame body 20. Then, when the user rotates the control assembly 50 upwardly from the angle shown in FIG. 12, the pushing portion of the control assembly 50 and the abutting portion of the latching assembly 80 are kept in contact with each other and are rotated synchronously about the first axis A1. The lever members 81 of the latching assembly 80 obtain the torsion from the control assembly 50 (corresponding to the counterclockwise direction) to temporarily resist the torsion from elastic member 90 (corresponding to the clockwise direction), so that the upper end of each lever member 81 moves frontward and the lower end of each lever member 81 moves backward to drive the pin member 84 to move backward in the locking direction D2 for making the latching assembly 80 move from the lock position as shown in FIG. 12 to the release position as shown in FIG. 13.

When the first position adjusting device 4 is in a state shown in FIG. 13, the user is able to move the second frame body 20 up and down along the adjusting direction D1 within a predetermined range so as to adjust the height of the saddle 6. During the height adjustment, the user still needs to hold the control assembly 50 to maintain the latching assembly 80 at the release position, so that the second frame body 20 can smoothly move up and down without interference of the pin member 84. When the second frame body 20 is adjusted to an appropriate height, the use can release the control assembly 50 for allowing the latching assembly 80 to move to the lock position by the elastic member 90, and the control assembly 50 is rotated from the angle shown in FIG. 13 to the angle shown in FIG. 12.

In the state shown in FIG. 12, although the second frame body 20 cannot move up and down, it may still loose slightly in other directions, so the second frame body 20 has to be further locked, that is, the user can push the handle 54 of the control assembly 50 downward to make the control assembly 50 rotate downward from the angle shown in FIG. 12. At first, the axle component 61 of the control assembly 50 will stop at the second tightening position, and then the user has to apply a force to compress the two elastic washers 66 to shorten the distance between the deflection and the axle portion until the angle shown in FIG. 11, and the elastic restoring force of the elastic washers 66 becomes an assistance force to help the control assembly 50 rotating downward until the control assembly 50 is stopped at the angle shown in FIG. 10, such that the pressing member 40 and the axle component 61 respectively return to the first tightening position and the second tightening position to press the second frame body 20 so as to fix the second frame body 20. Under this arrangement, the first position adjusting device 4 allows the user to quickly release the second frame body 20 relative to the first frame body 10. It is convenient for the user to adjust the position of the second frame body 20 relative to the first frame body 10.

Referring to FIG. 0.14, the second position adjusting device 5 in accordance with the second embodiment is similar to the first position adjusting device 4 in accordance with the first embodiment. The second position adjusting device 5 also has a first frame body 10' and a second frame body 20' which form a telescopic rod structure, two opposite bushing members 30' mounted at the top end of the first frame body 10', a pressing member 40' disposed at the first side (right side in the figure) of the first frame body 10', a control assembly 50' disposed at the second side (left side in the figure) of the first frame body 10', and two connecting arms 70' connected between the pressing member 40' and the control assembly 50'. The control assembly 50' has a main component 51', an axle component 61', two elastic washers 66', a hexagonal nut 67' and a screw bolt 68'. The second embodiment is similar to the first embodiment, except that the second position adjusting device 5 does not have the aforementioned latching assembly 80 and the elastic member 90 of the first position adjusting device 4, and the adjusting direction and the arrangement of the first side and the second are reversed. Also, the second position adjusting device 5 does not have the cylindrical member 16 disposed at the second side of the first frame body 10', and a plurality of positioning holes 25 in the second side of the second frame body 20'.

Figure 14:
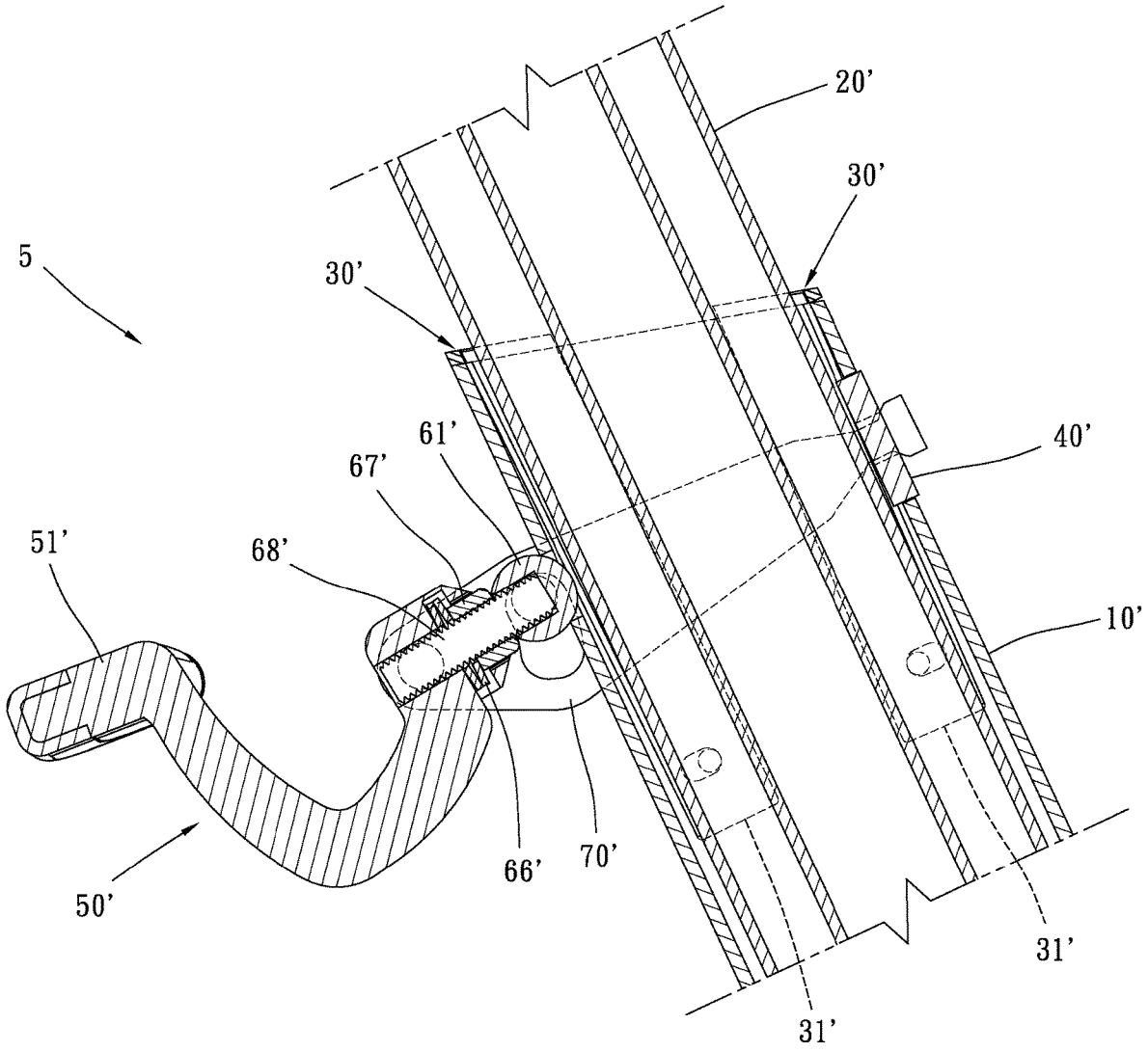
FIG. 14 is a longitudinal sectional view of the position adjusting device of the second embodiment.

In short, when the second position adjusting device 5 is in a lock state as shown in FIG. 14, the second frame body 20' only fastened by means of clamping, namely the pressing member 40' and the axle component 61' clamp the second frame body 20' through wedge blocks 31' of the bushing members 30' by two opposite sides to lock the second frame body 20' without any latching lock as the first position adjusting device 4 of the first embodiment. The operation and principle for locking and releasing the second position adjusting device 5 are basically the same as the first position adjusting device 4. Since the second position adjusting device 5 is used to support the handle set 7 on the stationary bike 1, that is, to support the pressure of hands or upper body weight of the user, the load of which is relatively light, there is no need to support the whole body weight of the user as the first position adjusting device 4 must have a latching lock mechanism to ensure stability. In other words, in the second embodiment, the second frame body 20' of the second position adjusting device 5 locked by the aforementioned mechanism can stably support a predetermined weight.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A position adjusting device for use in an exercising apparatus, the position adjusting device comprising:

a first frame body and a second frame body, each defining an adjusting direction and a locking direction which are substantially perpendicular to one another, the second frame body being movable relative to the first frame body along the adjusting direction, the first frame body and the second frame body each having a first side and a second side opposite to each other in the locking direction, the first side of the second frame body having at least one first pressurized surface extending in the adjusting direction, the second side of the second frame body having at least one second pressurized surface extending in the adjusting direction;

a pressing member disposed at the first side of the first frame body and located outside the at least one first pressurized surface of the second frame body for pressing the second frame body toward the second side of the first frame body and being movable between a first tightening position relatively close to the second side of the first frame body and a first loosening position relatively away from the second side of the first frame body;

a control assembly mounted at the second side of the first frame body and located outside the at least one second pressurized surface of the second frame body, the control assembly having an axle portion, a deflection portion, an elastic portion and a pressing portion, the deflection portion being farther from the pressing member than the axle portion, the elastic portion disposed between the deflection portion and the axle portion so that a distance between the deflection portion and the axle portion is variable between a maximum length and a minimum length, the elastic portion configured to provide an elastic restoring force for biasing the deflection portion away from the axle portion, the pressing portion configured to press the second frame body toward the first side of the first frame body and together with the axle portion to be movable between a second tightening position relatively close to the first side of the first frame body and a second loosening position relatively away from the first side of the first frame body; and at least one connecting arm having a first end and a second end opposite to each other, the first end coupled to the pressing member and the second end coupled to the deflection portion of the control assembly;

wherein the control assembly is deflectable about the axle portion so that the deflection portion is able to move from a first position through a second position to a third position; when the deflection portion is located at the first position, the distance between the deflection portion and the axle portion is a specific length between the maximum length and the minimum length, and the pressing portion and the pressing member are respectively located at the second tightening position and the first tightening position; when the deflection portion is located at the second position, the distance between the deflection portion and the axle portion is the minimum length, and the pressing portion and the pressing member are respectively located at the second tightening position and the first tightening position; and when the deflection portion is located at the third position, the distance between the deflection portion and the axle portion is greater than the specific length, and the pressing portion and the pressing member are respectively located at the second loosening position and the first loosening position.

2. The position adjusting device as claimed in claim 1, wherein the second frame body has a plurality of positioning holes equally spaced along the adjusting direction; the position adjusting device further comprises a latching assembly mounted on the first frame body and an elastic member mounted between the first frame body and the latching assembly, the latching assembly having an abutting portion and a positioning portion, the latching assembly being movable between a lock position where the positioning portion is inserted into one of the positioning holes and a release position where the positioning portion is not inserted into the position holes, the elastic member configured to bias the latching assembly to the lock position; and the control assembly further comprises a pushing portion, the deflection portion being able to further move from the third position to a fourth position in a direction away from the second position relative to the axle portion, when the deflection portion is located at the fourth position, the pushing portion of the control assembly abuts against the abutting portion of the latching assembly and pushes the latching assembly to the release position.

3. A position adjusting device for use in an exercising apparatus, the position adjusting device comprising:

a first frame body and a second frame body, each defining an adjusting direction and a locking direction which are substantially perpendicular to one another, the second frame body being movable relative to the first frame body along the adjusting direction, the first frame body and the second frame body each having a first side and a second side opposite to each other in the locking direction, the first side of the second frame body having at least one first pressurized surface extending in the adjusting direction, the second side of the second frame body having a plurality of positioning holes equally spaced along the adjusting direction;

a pressing member disposed at the first side of the first frame body and located outside the at least one first pressurized surface of the second frame body for pressing the second frame body toward the second side of the first frame body and being movable between a first tightening position relatively close to the second side of the first frame body and a first loosening position relatively away from the second side of the first frame body;

a control assembly mounted at the second side of the first frame body, having an axle portion, a deflection portion, an elastic portion and a pushing portion, the deflection portion being farther from the pressing member than the axle portion, the elastic portion disposed between the deflection portion and the axle portion so that a distance between the deflection portion and the axle portion is variable between a maximum length and a minimum length, the elastic portion configured to provide an elastic restoring force for biasing the deflection portion away from the axle portion;

at least one connecting arm having a first end and a second end opposite to each other, the first end coupled to the pressing member and the second end coupled to the deflection portion of the control assembly;

a latching assembly mounted on the second side of the first frame body, having an abutting portion and the positioning portion, the latching assembly being movable between a lock position where the positioning portion is inserted into one of the positioning holes of the second frame body and a release position where the positioning portion is not inserted into any position holes; and an elastic member mounted between the first frame body and the latching assembly, being configured to bias the latching assembly to the lock position;

wherein the control assembly is deflectable about the axle portion so that the deflection portion is able to move from a first position through a second position and a third position to a fourth position; when the deflection portion is located at the first position, the distance between the deflection portion and the axle portion is a specific length between the maximum length and the minimum length, and the pressing member is located at the first tightening position; when the deflection portion is located at the second position, the distance between the deflection portion and the axle portion is the minimum length, and the pressing member is located at the first tightening position; when the deflection portion is located at the third position, the distance between the deflection portion and the axle portion is greater than the specific length, and the pressing member is located at the first loosening position; and when the deflection portion is located at the fourth position, the pushing portion of the control assembly abuts against the abutting portion of the latching assembly and pushes the latching assembly to the release position.

4. The position adjusting device as claimed in claim 3, wherein the axle portion of the control assembly is pivotally mounted to a fixed position on the second side of the first frame body.

5. The position adjusting device as claimed in claim 3, wherein the second side of the second frame body has at least one second pressurized surface extending in the adjusting direction; the control assembly further has a pressing portion configured to press the second frame body toward the first side of the first frame body and together with the axle portion to be movable between a second tightening position relatively close to the first side of the first frame body and a second loosening position relatively away from the first side of the first frame body; when the deflection portion of the control assembly is located at the first position or the second position, the pressing portion is located at the second tightening position; and when the deflection portion of the control assembly is located at the third position, the pressing portion is located at the second loosening position.

6. The position adjusting device as claimed in claim 1, wherein when the deflection of the control assembly is located at the first position, two of the control assembly, the connecting arm and the first frame body are interfered with each other so that the deflection portion of the control assembly cannot be moved continuously from the first position in a direction away from the second position.

7. The position adjusting device as claimed in claim 3, wherein when the deflection portion of the control assembly is located at the first position, two of the control assembly, the connecting arm and the first frame body are interfered with each other so that the deflection portion of the control assembly cannot be moved continuously from the first position in a direction away from the second position.

8. The position adjusting device as claimed in claim 1, wherein the first frame body has a first side wall at the first side and located outside the at least one first pressurized surface of the second frame body, the first frame body having a first aperture through the first side wall, the pressing member being embedded in the first aperture and movable along the locking direction, when the pressing member is located at the first tightening position, the pressing member is projected toward the first side of the second frame body from an inner side surface of the first side wall.

9. The position adjusting device as claimed in claim 3, wherein the first frame body has a first side wall at the first side and located outside the at least one first pressurized surface of the second frame body, the first frame body having a first aperture through the first side wall, the pressing member being embedded in the first aperture and movable along the locking direction, when the pressing member is located at the first tightening position, the pressing member is projected toward the first side of the second frame body from an inner side surface of the first side wall.

10. The position adjusting device as claimed in claim 1, wherein the first frame body has a second side wall at the second side and located outside the at least one second pressurized surface of the second frame body, the second frame body having a second aperture through the second side wall, the second aperture defining two parallel edges; the control assembly has a cylindrical member partially engaged in the second aperture and movable along the locking direction, the cylindrical member having a semi-cylindrical surface and an axis of the semi-cylindrical surface being parallel to the two edges of the second aperture; part of the control assembly corresponding to the axis of the semi-cylindrical surface is defined as the axle portion, and part of the semi-cylindrical surface forms the pressing portion; and when the pressing portion is located at the second tightening position, the semi-cylindrical surface abuts against two edges of the second aperture, and the part of the semi-cylindrical surface as the pressing portion is projected toward the second side of the second frame body from an inner side surface of the second side wall.

11. The position adjusting device as claimed in claim 5, wherein the first frame body has a second side wall at the second side and located outside the at least one second pressurized surface of the second frame body, the second frame body having a second aperture through the second side wall, the second aperture defining two parallel edges; the control assembly has a cylindrical member partially engaged in the second aperture and movable along the locking direction, the cylindrical member having a semi-cylindrical surface and an axis of the semi-cylindrical surface being parallel to the two edges of the second aperture; part of the control assembly corresponding to the axis of the semi-cylindrical surface is defined as the axle portion, and part of the semi-cylindrical surface forms the pressing portion; and when the pressing portion is located at the second tightening position, the semi-cylindrical surface abuts against two edges of the second aperture, and the part of the semi-cylindrical surface as the pressing portion is projected toward the second side of the second frame body from an inner side surface of the second side wall.

12. The position adjusting device as claimed in claim 1, further comprising four wedge blocks each having an inclined surface, wherein two wedge blocks are arranged in between the pressing member and the at least one first pressurized surface for pressing the at least one first pressurized surface with the inclined surface as the pressing member is moved to the first tightening position, and the other two wedge blocks are arranged in between the pressing portion of the control assembly and the at least one second pressurized surface with the inclined surface as the pressing portion is moved to the second tightening position, the inclined surfaces of the four wedge blocks facing toward the second frame body in different directions.

13. The position adjusting device as claimed in claim 5, further comprising four wedge blocks each having an inclined surface, wherein two wedge blocks are arranged in between the pressing member and the at least one first pressurized surface for pressing the at least one first pressurized surface with the inclined surface as the pressing member is moved to the first tightening position, and the other two wedge blocks are arranged in between the pressing portion of the control assembly and the at least one second pressurized surface with the inclined surface as the pressing portion is moved to the second tightening position, the inclined surfaces of the four wedge blocks facing toward the second frame body in different directions.

14. The position adjusting device as claimed in claim 2, wherein the pushing portion of the control assembly and the abutting portion of the latching assembly are able to be magnetically attracted together.

15. The position adjusting device as claimed in claim 3, wherein the pushing portion of the control assembly and the abutting portion of the latching assembly are able to be magnetically attracted together.

16. A position adjusting device for use in an exercising apparatus, the position adjusting device comprising:

a first frame body and a second frame body, each defining an adjusting direction and a locking direction which are substantially perpendicular to one another, the second frame body being movable relative to the first frame body along the adjusting direction, the first frame body and the second frame body each having a first side and a second side opposite to each other in the locking direction, the first side of the second frame body having at least one first pressurized surface extending in the adjusting direction, the second side of the second frame body having a plurality of positioning holes equally spaced along the adjusting direction;

a pressing member disposed at the first side of the first frame body and located outside the at least one first pressurized surface of the second frame body for pressing the second frame body toward the second side of the first frame body and being movable between a first tightening position relatively close to the second side of the first frame body and a first loosening position relatively away from the second side of the first frame body;

a control assembly mounted at the second side of the first frame body, having an axle portion, a deflection portion, an elastic portion and a pushing portion, the deflection portion being farther from the pressing member than the axle portion, the elastic portion disposed between the deflection portion and the axle portion so that a distance between the deflection portion and the axle portion is variable between a maximum length and a minimum length, the elastic portion configured to provide an elastic restoring force for biasing the deflection portion away from the axle portion;

at least one connecting arm having a first end and a second end opposite to each other, the first end coupled to the pressing member and the second end coupled to the deflection portion of the control assembly; and a latching assembly mounted on the second side of the first frame body, having an abutting portion and the positioning portion, the latching assembly being movable between a lock position where the positioning portion is inserted into one of the positioning holes of the second frame body and a release position where the positioning portion is not inserted into any position holes;

wherein the pushing portion of the control assembly is configured to abut against the abutting portion of the latching assembly and to push the latching assembly to the release position.

17. The position adjusting device as claimed in claim 16, further comprising an elastic member mounted between the first frame body and the latching assembly, being configured to bias the latching assembly to the lock position.

18. The position adjusting device as claimed in claim 16, wherein the control assembly is deflectable about the axle portion so that the deflection portion is able to move from a first position through a second position and a third position to a fourth position; when the deflection portion is located at the first position, the distance between the deflection portion and the axle portion is a specific length between the maximum length and the minimum length, and the pressing member is located at the first tightening position; when the deflection portion is located at the second position, the distance between the deflection portion and the axle portion is the minimum length, and the pressing member is located at the first tightening position; when the deflection portion is located at the third position, the distance between the deflection portion and the axle portion is greater than the specific length, and the pressing member is located at the first loosening position; and when the deflection portion is located at the fourth position, the pushing portion of the control assembly abuts against the abutting portion of the latching assembly and pushes the latching assembly to the release position.

19. The position adjusting device as claimed in claim 16, wherein the pushing portion of the control assembly and the abutting portion of the latching assembly are able to be magnetically attracted together.

* * * * *